US009276317B1

(12) United States Patent
Zheng

(10) Patent No.: US 9,276,317 B1
(45) Date of Patent: Mar. 1, 2016

(54) QUAD-MODE ANTENNA

(75) Inventor: Ming Zheng, Cupertino, CA (US)

(73) Assignee: Amazon Technologies, Inc., Reno, NV (US)

( * ) Notice: Subject to any disclaimer, the term of this patent is extended or adjusted under 35 U.S.C. 154(b) by 524 days.

(21) Appl. No.: 13/557,001

(22) Filed: Jul. 24, 2012

Related U.S. Application Data

(60) Provisional application No. 61/605,842, filed on Mar. 2, 2012.

(51) Int. Cl.

| | |
|---|---|
| ***H01Q 7/00*** | (2006.01) |
| ***H01Q 1/24*** | (2006.01) |
| ***H01Q 9/16*** | (2006.01) |
| ***H01Q 9/26*** | (2006.01) |

(52) U.S. Cl.
CPC ..... *H01Q 7/00* (2013.01); *H01Q 1/243* (2013.01); *H01Q 9/26* (2013.01)

(58) Field of Classification Search
CPC ..... H01Q 1/243; H01Q 1/242; H01Q 7/00; H01Q 1/241; H01Q 1/24; H01Q 5/00; H01Q 5/15; H01Q 5/35; H01Q 5/357; H01Q 5/364; H01Q 5/30; H01Q 9/16; H01Q 9/26
USPC ..... 343/742, 747, 748
See application file for complete search history.

(56) References Cited

U.S. PATENT DOCUMENTS

| | | | | |
|---|---|---|---|---|
| 6,329,951 | B1 * | 12/2001 | Wen et al. | 343/702 |
| 7,705,791 | B2 * | 4/2010 | Ollikainen | 343/702 |
| 7,768,466 | B2 * | 8/2010 | Chi et al. | 343/741 |
| 8,684,272 | B2 * | 4/2014 | Wong et al. | 235/492 |
| 2006/0017635 | A1 * | 1/2006 | Zheng | 343/748 |
| 2012/0223867 | A1 * | 9/2012 | Morton et al. | 343/742 |

* cited by examiner

*Primary Examiner* — Dameon E Levi
*Assistant Examiner* — Jennifer F Hu
(74) *Attorney, Agent, or Firm* — Lowenstein Sandler LLP

(57) ABSTRACT

Methods, apparatuses, and systems for quad-mode antennas of user devices are described. The quad-mode antenna includes a loop element coupled to a single radio frequency (RF) input and ground. The loop element is configured to operate in four resonant modes to radiate electromagnetic energy in response to the single RF input.

20 Claims, 13 Drawing Sheets

Antenna has very wideband at both LB and HB, in particular at HB $f$ = 900MHz, 2 x 1/4 λ folded monopole
Balanced

$f$ = 1400MHz, 2 x 3/4 λ folded monopole
Balanced

Antenna has very good efficiency at both LB and HB

Antenna, again, has very good efficiency at both LB and HB at BHR (Beside Head Right)

QUAD-MODE ANTENNA

RELATED APPLICATIONS

This application claims the benefit of U.S. Provisional Application No. 61/605,842, filed Mar. 2, 2012, the entire contents of which are incorporated by reference.

BACKGROUND

A large and growing population of users is enjoying entertainment through the consumption of digital media items, such as music, movies, images, electronic books, and so on. The users employ various electronic devices to consume such media items. Among these electronic devices (referred to herein as user devices) are electronic book readers, cellular telephones, personal digital assistants (PDAs), portable media players, tablet computers, netbooks, laptops, and the like. These electronic devices wirelessly communicate with a communications infrastructure to enable the consumption of the digital media items. In order to wirelessly communicate with other devices, these electronic devices include one or more antennas.

The conventional antenna usually has only one resonant mode in the lower frequency band and one resonant mode in the high band. One resonant mode in the lower frequency band and one resonant mode in the high band may be sufficient to cover the required frequency band in some scenarios, such as in 3G applications. 3G, or 3rd generation mobile telecommunication, is a generation of standards for mobile phones and mobile telecommunication services fulfilling the International Mobile Telecommunications-2000 (IMT-2000) specifications by the International Telecommunication Union. Application services include wide-area wireless voice telephone, mobile Internet access, video calls and mobile TV, all in a mobile environment. The required frequency bands for 3G applications may be GSM850/EGSM in low band and DCS/PCS/WCDMA in high band. The 3G band is between 824 MHz and 960 MHz. Long Term Evolution (LTE) and LTE Advanced (sometimes generally referred to as 4G) are communication standards that have been standardized by the 3rd Generation Partnership Project (3GPP). However, in order to extend the frequency coverage down to 700 MHz for 4G/LTE application, antenna bandwidth needs to be increased especially in the low band. There are two common LTE bands used in the United States from 704 MHz-746 MHz (Band 17) and from 746 MHz-787 MHz (Band 13). Conventional solutions increase the antenna size or use active tuning elements to extend the bandwidth. Alternatively, conventional solutions use separate antennas to achieve different frequency bands and use a switch to switch between the antennas. These solutions are not conducive to use in user devices, often because of the size of the available space for antennas within the device.

BRIEF DESCRIPTION OF THE DRAWINGS

The present invention will be understood more fully from the detailed description given below and from the accompanying drawings of various embodiments of the present invention, which, however, should not be taken to limit the present invention to the specific embodiments, but are for explanation and understanding only.

DETAILED DESCRIPTION

Figure 1:
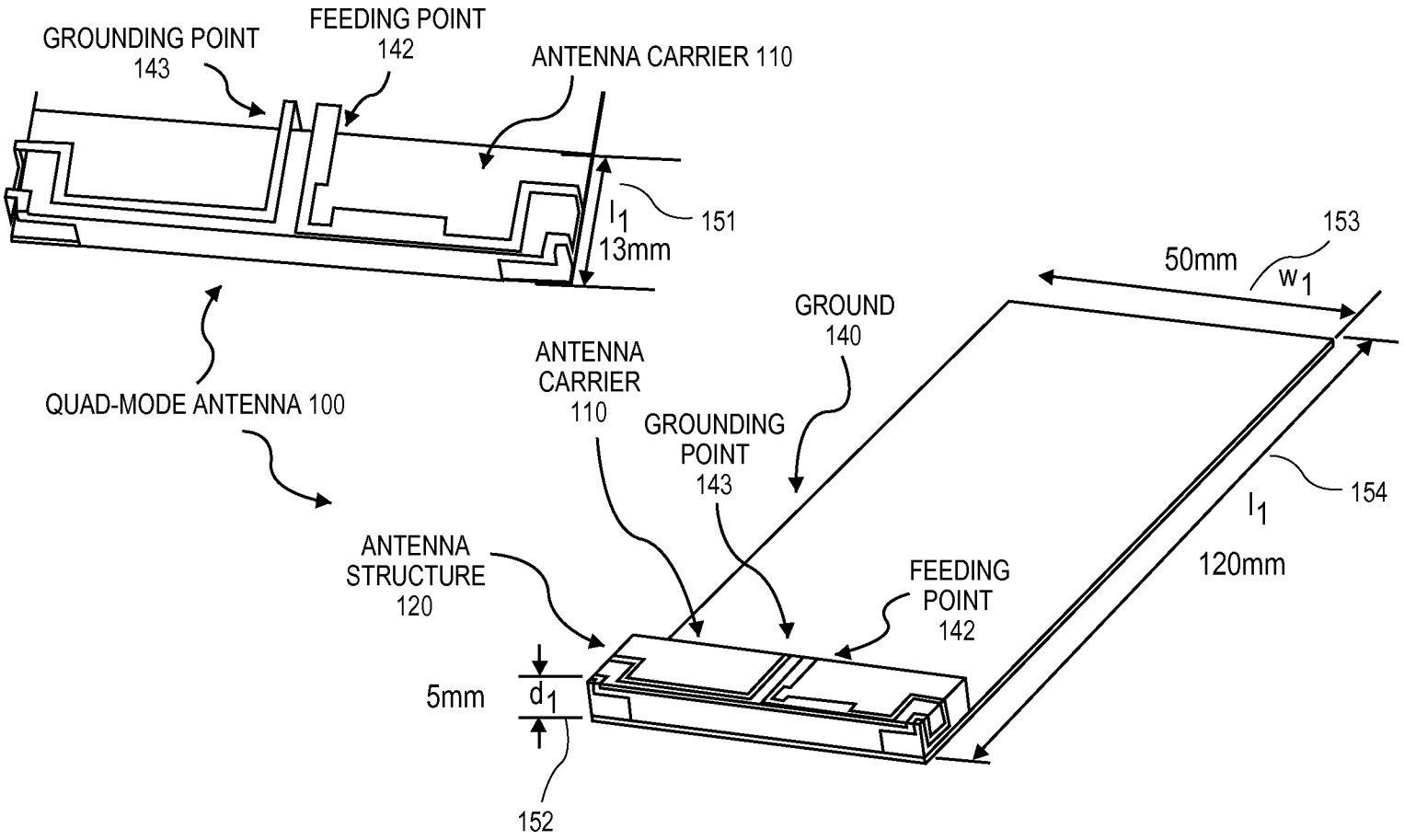
FIG. 1 illustrates two views of a quad-mode antenna according to one embodiment.

Methods, apparatuses, and systems for quad-mode antennas of user devices are described. The quad-mode antenna is coupled to a single radio frequency (RF) input and ground and the quad-mode antenna provides four resonant modes. In one embodiment, the quad-mode antenna is a hexa-band internal folded monopole/dipole/loop antenna. In this embodiment, the quad-mode antenna covers six frequency bands. Alternatively, the quad-mode antenna may cover at least three frequency bands and may even cover up to eight frequency bands as described herein. The user device may be any content rendering device that includes a wireless modem for connecting the user device to a network. Examples of such user devices include electronic book readers, portable digital assistants, mobile phones, laptop computers, portable media players, tablet computers, cameras, video cameras, netbooks, notebooks, desktop computers, gaming consoles, DVD players, media centers, and the like. The user device may connect to a network to obtain content from a server computing system (e.g., an item providing system) or to perform other activities. The user device may connect to one or more different types of cellular networks.

As described above, the conventional antenna usually has only one resonant mode in the lower frequency band and one resonant mode in the high band. The embodiments described herein of the quad-mode antenna can achieve four resonant modes, including three resonant modes in the high band (HB) and one in the low band (LB). In one embodiment, the quad-mode antenna extends the frequency coverage down to 700 MHz for use in 4G/LTE applications, as well as provides additional resonances in the high band. In one embodiment, the quad-mode antenna is driven by a single RF input and coupled to a ground plane.

In one embodiment, the quad-mode antenna may be a hexa-band internal folded monopole/dipole/loop antenna. The proposed antenna has four resonances in which three of them are 0.5λ, 1λ, and 1.5λ modes. The distinctive feature of the antenna is an extra 2λ folded dipole mode that is excited and utilized to achieve four modes. For example, these four modes can be employed to cover the Low LTE700/GSM850/900 Band (LB: 698-960 MHz) and the High GSM1850/1900/UMTS2100 Band (HB: 1710-2170 MHz). One embodiment of the proposed loop antenna has been simulated, prototyped, and tested.

There has been growing interest on multi-band loop antennas for mobile communication systems due to their unique multi-mode features. Up to three resonant modes can be generated with a single loop antenna, which offers unique advantages over a conventional Planar Inverted-F Antenna (PIFA) and monopole antenna. The loop antenna can be considered as a folded monopole antenna operating as an unbalanced two quarter-wavelengths mode (2×¼λ) and two three-quarter wavelengths mode (2×¾λ). The 2×¼λ mode results in a total length of 0.5λ, and thus is referred to as 0.5λ mode. Similarly, the 2×¾λ mode results in a total length of 1.5λ, and thus is referred to as 1.5λ mode. It should also be noted that references to the wavenumbers, e.g., 0.5λ, 1.0λ, 1.5λ, and 2λ, where λ is wavelength, refers to the length of the radiating element, and in particular, the wavenumber means that the length of the radiating element is a multiple of the wavenumber. For example, the 0.5λ means that the length of the radiating element is a multiple of half a wavelength. Also, the references to the wavenumbers in connection with the resonant modes means that the lengths of the radiating structure in the respective mode are multiples of the respective wavelengths. For example, in the 0.5λ mode, the length of the radiating element of the quad-mode antenna is a multiple of half wavelength as would be appreciated by one of ordinary skill in the art having the benefit of this disclosure. It should also be noted that wavelength is inversely proportional to frequency and waves with higher frequencies have shorter wavelengths and lower frequencies have longer wavelengths. It should also be noted that a balanced mode is when the antenna structure of the quad-mode antenna has two conductors of the same type, each of which have equal impedances along their lengths and equal impedances to ground. An unbalanced mode is when the antenna structure has conductors having unequal impedances with respect to ground. A folded monopole is a class of radio antennas that includes a conductor that is often mounted perpendicular to a ground plane, and the conductor has a bend to extend in another direction. In addition to the loop antenna being considered as a folded monopole antenna operating as an unbalanced 2×¼λ and 2×¾λ mode, the loop antenna can be perceived as a folded dipole antenna operating a balanced 2×½ wavelength (1λ) mode. The folded dipole antenna has two substantially identical conductors with the RF signal applied between the two conductors (e.g., two halves of the antenna). The quad-mode antenna may also be considered a folded monopole/dipole/loop antenna 4×½λ(2λ) mode, as described herein. This antenna can operate as a folded monopole as well as a folded dipole with 0.5λ, 1.5λ, 1λ, and 2λ modes simultaneously. This may enable the antenna to cover multiple frequency bands, including multiple cellular bands including the LTE700/GSM850/900 band (824-960 MHz) and GSM1850/1900/UMTS2100 band (1710-2170 MHz) which normally cannot be readily covered by either a single PIFA or monopole antenna.

Although much effort has been devoted to develop numerous folded monopole/dipole/loop antennas, conventional antennas have at most three resonances and a limited HB bandwidth due to merely two usable modes. Described herein are embodiments of internal hexa-band folded monopole/dipole/loop antennas for mobile communication systems. Not only is the quad-mode antenna capable of generating three resonances namely, 0.5λ, 1.5λ and 1λ modes, but it can also excite an extra 2λ mode, resulting in four modes. All of these four modes can thus be utilized to cover wide cellular bands including a hexa-band, including the Low LTE700/GSM850/900 Band (LB: 698-960 MHz) and the High GSM1850/1900/UMTS2100 Band (HB: 1710-2170 MHz). As described herein, an embodiment of the antenna has been simulated, prototyped and tested, and the measured antenna's reflection coefficient and radiation efficiency indicate that the antenna operates as expected to achieve the four resonant modes, covering three or more frequency bands. In some embodiment, the quad-band antenna may cover up to eight frequency bands.

FIG. 1 illustrates two views of a quad-mode antenna 100 according to one embodiment. In this embodiment, the quad-mode antenna 100 is fed at a single RF input 142 at a first end of an antenna structure 120 and a second end of the antenna structure 120 is coupled to a radiation ground plane 140. The first end of antenna structure 120 is directly driven by the single RF input 142. Although the second end is electrically connected is coupled to the ground plane 140. In particular, by directly inducing current on the antenna structure 120 by the single RF input 142, the antenna structure 120 radiates electromagnetic energy in one of the different resonant modes. As described herein, the antenna structure 120 can be operated in four resonances namely, 0.5λ, 1.5λ, 1λ, and 2λ modes. The dimensions of the antenna structure 120 may be varied to achieve the desired frequency ranges as would be appreciated by one of ordinary skill in the art having the benefit of this disclosure, however, the total length of the antennas is a major factor for determining the frequency, and the width of the antennas is a factor for impedance matching. It should be noted that the factors of total length and width are dependent on one another.

In FIG. 1, the ground plane 140 may be a metal frame of a user device. The ground plane 140 may be a system ground or one of multiple grounds of the user device. The RF input 142 may be a feed line connector that couples the quad-mode antenna 100 to a feed line (also referred to as the transmission line), which is a physical connection that carriers the RF signal to and/or from the quad-mode antenna 100. The feed line connector may be any one of the three common types of feed lines, including coaxial feed lines, twin-lead lines, or waveguides. A waveguide, in particular, is a hollow metallic conductor with a circular or square cross-section, in which the RF signal travels along the inside of the hollow metallic conductor. Alternatively, other types of connectors can be used. In the depicted embodiment, the feed line connector is directly connected to the first end of antenna structure 120.

In one embodiment, the quad-mode antenna 100 is disposed on an antenna carrier 110, such as a dielectric carrier of the user device. The antenna carrier 110 may be any non-conductive material, such as dielectric material, upon which the conductive material of the quad-mode antenna 100 can be disposed without making electrical contact with other metal of the user device. In another embodiment, portions of the quad-mode antenna 100 may be disposed on or within a circuit board, such as a printed circuit board (PCB). Alternatively, the quad-mode antenna 100 may be disposed on other components of the user device or within the user device as would be appreciated by one of ordinary skill in the art having the benefit of this disclosure. It should be noted that the quad-mode antenna 100 illustrated in FIG. 1 is a three-dimensional (3D) structure. However, as described herein, the quad-mode antenna 100 may be implemented as a 2D structure, as well as other variations than those depicted in FIG. 1. In one embodiment, the antenna structure 120 can be partially disposed on two or more sides of the antenna carrier 110. For example, the antenna structure 120 can be disposed on a front surface and a top surface of the antenna carrier and one or more side surfaces. Alternatively, the antenna structure 120 can be disposed on the front surface, the back surface, the top surface and zero or more of the two sides. Alternatively, portions of the quad-mode antenna can be disposed in various configurations as would be appreciated by one of ordinary skill in the art having the benefit of this disclosure. However, as described herein, the quad-mode antenna may be a planar 2D structure.

Using the antenna structure 120, the quad-mode antenna 100 can create multiple resonant modes using the single RF input 142, such as four resonant modes. In one embodiment, the antenna structure 120 are configured to extend a bandwidth of the quad-mode antenna 100 in both the low band (LB) and in the high band (HB). In one embodiment, the quad-mode antenna 100 has multiple resonant modes with frequencies in the LB, such as LTE700/GSM850/900 Band (LB: 698-960 MHz), and frequencies in the HB, such as GSM1850/1900/UMTS2100 Band (HB: 1710-2170 MHz). Alternatively, other frequencies may be covered by the antenna structure 120, such as a frequency range from 1.7 GHz to 2.4 GHz in the HB. In one embodiment, the antenna structure 120 is configured to provide a first resonant mode, centered at 700 MHz, second resonate mode, centered at 900 MHz, third mode, centered at 1.8 GHz, and a fourth resonant mode, centered at 2.2 GHz. In another embodiment, the quad-mode antenna 100 can be configured to create a resonant mode for LTE 700 plus resonant modes for penta-band. Alternatively, other frequency bands may be covered in the four resonant modes of the quad-mode antenna 100. In telecommunications, the terms multi-band, dual-band, tri-band, quad-band, and penta-band refer to a device, such as the user device described herein, supporting multiple RF bands used for communication. In other embodiments, the antennas can be designed to cover an eight-band LTE/GSM/UMTS, the GSM850/900/1800/1900/UMTS penta-band operation, or the LTE700/GSM850/900 (698-960 MHz) and GSM 1800/190/UMTS/LTE2300/2500 (1710-2690) MHz operation. In the user device context, the purpose of doing so is to support roaming between different regions whose infrastructure cannot support mobile services in the same frequency range. These frequency bands may be Universal Mobile Telecommunication Systems (UMTS) frequency bands, GSM frequency bands, or other frequency bands used in different communication technologies, such as, for example, cellular digital packet data (CDPD), general packet radio service (GPRS), enhanced data rates for GSM evolution (EDGE), 1 times radio transmission technology (1×RTT), evaluation data optimized (EVDO), high-speed downlink packet access (HSDPA), WiFi, WiMax, etc.

In one embodiment, the quad-mode antenna 100 provides two or more resonant modes. The resonant modes may cover at least one of the following: a first frequency band at 700 MHz, a second frequency band at 850 MHz, a third frequency band at 900 MHz, a fourth frequency band at 1.7 GHz, a fifth frequency band at 1.8 GHz, a sixth frequency band at 1.9 GHz, a seventh frequency band at 2.0 GHz, a eighth frequency band at 2.1 GHz, a ninth frequency band at 2.2 GHz, a tenth frequency band at 2.3 GHz, or an eleventh frequency band at 2.6 GHz. Modifications to the dimensions of the portions of the antenna structure 120 may change the frequency and impedance matching of the quad-mode antenna 100 as would be appreciated by one of ordinary skill in the art having the benefit of this disclosure.

In the depicted embodiment, the antenna structure 120 is placed on the antenna carrier 110 having a depth (d1) 152 of 5 mm, a width (w1) 153 of 50 mm, and a height (h1) 151 of 13 mm. The antenna carrier 110 may be located at one end of a printed circuit board (PCB). The PCB may have a length (l1) of 120 mm. In this embodiment, there is a 13 mm ground plane clearance underneath the quad-mode antenna 100; therefore the total antenna volume is 50×13×5 $mm^3$. Of course, in other embodiments, the dimensions may vary to achieve the same total antenna volume or different total antenna volumes. In another embodiment, the antenna carrier 110 is disposed a top end of the PCB. In another embodiment, the antenna carrier 110 is disposed to over lap a portion of the PCB. In one embodiment, the PCB may be made of a 0.8 mm thick FR4 substrate of size of 120×50 $mm^2$ with relative permittivity of 4.4 and loss tangent of 0.02. The antenna carrier 110 may be made of PolyVinyl Chloride (PVC) with relative permittivity of 2.9 and loss tangent of 0.005. Of course, the PCB and antenna carrier 110 may be made of other materials as would be appreciated by one of ordinary skill in the art having the benefit of this disclosure. In another embodiment, portions of the quad-mode antenna 100 may be disposed on or within a circuit board, such as the depicted PCB. Alternatively, the quad-mode antenna 110 may be disposed on other components of the user device or within the user device as would be appreciated by one of ordinary skill in the art having the benefit of this disclosure.

Figure 2:
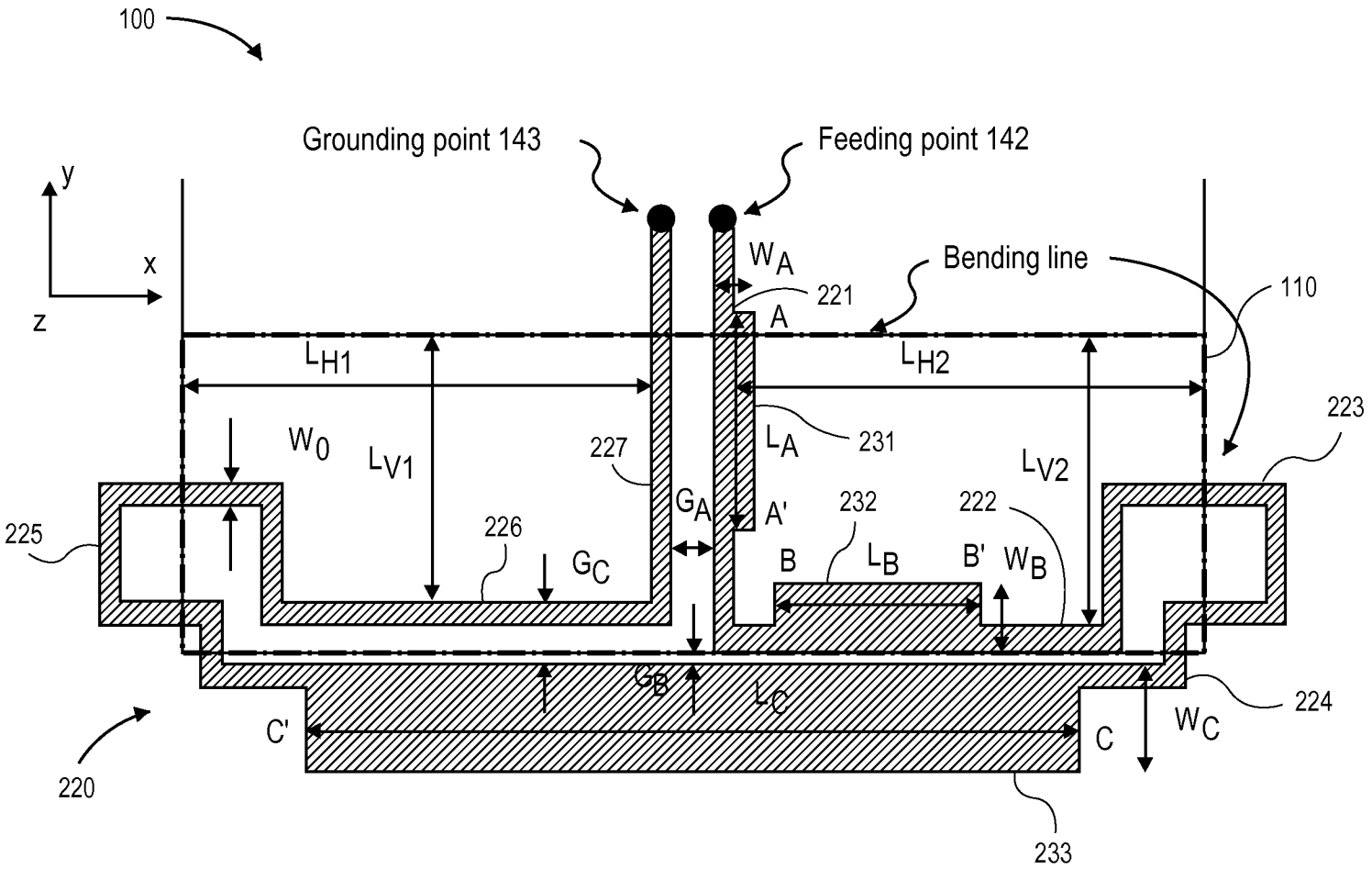
FIG. 2 illustrates a flattened two-dimensional view of the quad-mode antenna of FIG. 1 according to one embodiment.

While FIG. 1 indicates exemplary dimensions, FIG. 2 indicates detailed dimensions of the antenna structure 120 in an unfolded form in a planar 2D view (flattened 2D view).

FIG. 2 illustrates a flattened two-dimensional view of the quad-mode antenna of FIG. 1 according to one embodiment. In the depicted embodiment, the quad-mode antenna 100 includes a single continuous loop element 220. It should be noted that the single continuous loop element 220 of FIG. 2 is a flattened version of the antenna structure 120 of FIG. 1. The single continuous loop element 220 has a track width (W0) of 1 mm in some parts of its perimeter, except at the sections of A-A', B-B' and C-C' illustrated in FIG. 2. The antenna track of the loop element 220 is folded up around the bending lines donated as dot-dash ones to disposed the antenna structure 120 as a 3D structure on the antenna carrier 110.

In order to excite the extra 2λ resonance and utilize all modes in a contiguous manner, certain sections (e.g., 222 and 224) of the antenna track of the loop element 220 have been enlarged as shown in FIG. 2. This effectively loads or deloads specific resonant modes of the quad-mode antenna 100 capacitively or inductively. For example, the C-C' section 224 capacitively loads the 0.5λ resonant mode. In one embodiment, the antenna track of the loop element 220 is copper disposed on the antenna carrier 110.

In the depicted embodiment, the loop element 220 includes a first portion 221 that extends from the feeding point 142 away from the ground plane 140. In one embodiment, the first portion 221 is perpendicular to a top surface of the ground plane 140. The enlarged section 231 (labeled as A-A' section) extends out from a longitudinal axis of the first portion 221, causing portions of the first portion 221 to have a wider antenna track than other sections of the first portion 221. The loop element 220 bends at the top of the first portion 221, such as at a top edge of the antenna carrier 110, to form a second portion 222. The second portion 222 extends along the top edge towards a first side of the antenna carrier 110 (e.g., from a bend at a distal end of the first portion 221). The enlarged section 232 (labeled as B-B' section) extends out from a longitudinal axis of the second portion 222, causing portions of the second portion 222 to have a wider antenna track than other sections of the second portion 222. The loop element 220 includes a third portion 223 that loops around to form a loop near the first side of the antenna carrier 110. In this particular embodiment, the third portion 223 is wrapped along a first edge of the first side so that some of the third portion 223 is disposed on the front surface of the antenna carrier 110 and some of the third portion 223 is disposed on the first side of the antenna carrier 110. The third portion 223 is coupled to a forth portion disposed on the top side of the antenna carrier 110. The fourth portion extends along the top surface of the antenna carrier 110 towards a second side of the antenna carrier 110 from a distal end of the second portion. The enlarged section 233 (labeled as C-C' section) extends out from a longitudinal axis of the fourth portion 224. In one embodiment, the fourth portion 224 with the enlarged section 233 is a close-coupled structure. The loop element 220 also includes a fifth portion 225 that is similar to the third portion 223, but on the second side of the antenna carrier 110. In particular, the fifth portion 225 is wrapped along a first edge of the second side so that some of the fifth portion 224 is disposed on the front surface of the antenna carrier 110 and some of the fifth portion 225 is disposed on the second side of the antenna carrier 110. The fifth portion 225 is coupled to a sixth portion 226 that extends towards the first side. The sixth portion 226 is coupled to a seventh portion 227 that extends towards the grounding point of the ground plane. The seventh portion 227 is the second end of the antenna structure 120. The seventh portion 227 is coupled to a ground point 143 of the ground plane 140.

In one embodiment, the enlarged sections 231, 232, and 233 are considered coupling portions that are configured to increase coupling between different portions of the antenna structure 120. The coupling portions may also be configured to improve impedance matching between different portions of the antenna structure 120 and the RF feed 142.

It should also be noted that FIG. 2 illustrates the bending lines to indicate where the loop element 220 is folded around the antenna carrier 110 in one embodiment. Of course, the loop element 220 can be configured to wrap around one or more sides of the antenna carrier 110 in other configurations. Alternatively, the loop element 220 can be implemented as a 2D structure.

In one exemplary embodiment, the quad-mode antenna 100 has the following dimensions: $L_A$=5.8, $L_B$=10, $L_C$=37.8, $W_A$=2, $W_B$=2.8, $W_C$=4.5, $W_0$=1, $G_A$=2, $G_B$=0.5, $G_C$=1.5, $L_{H1}$=$L_{H2}$=23, $L_{V1}$=11 and $L_{V2}$=12 mm. The dimensions of the quad-mode antenna 100, the antenna carrier 110, and ground plane 140 of FIGS. 1 & 2 may be varied to achieve the desired frequency ranges as would be appreciated by one of ordinary skill in the art having the benefit of this disclosure, however, the total length of the antenna structure is a major factor for determining the frequency, and the width of the antenna is a factor for impedance matching. It should be noted that the factors of total length and width are dependent on one another.

One embodiment of the proposed antenna has been simulated, fabricated, and measured. The simulated and measured results are shown in FIG. 3.

Figure 3:
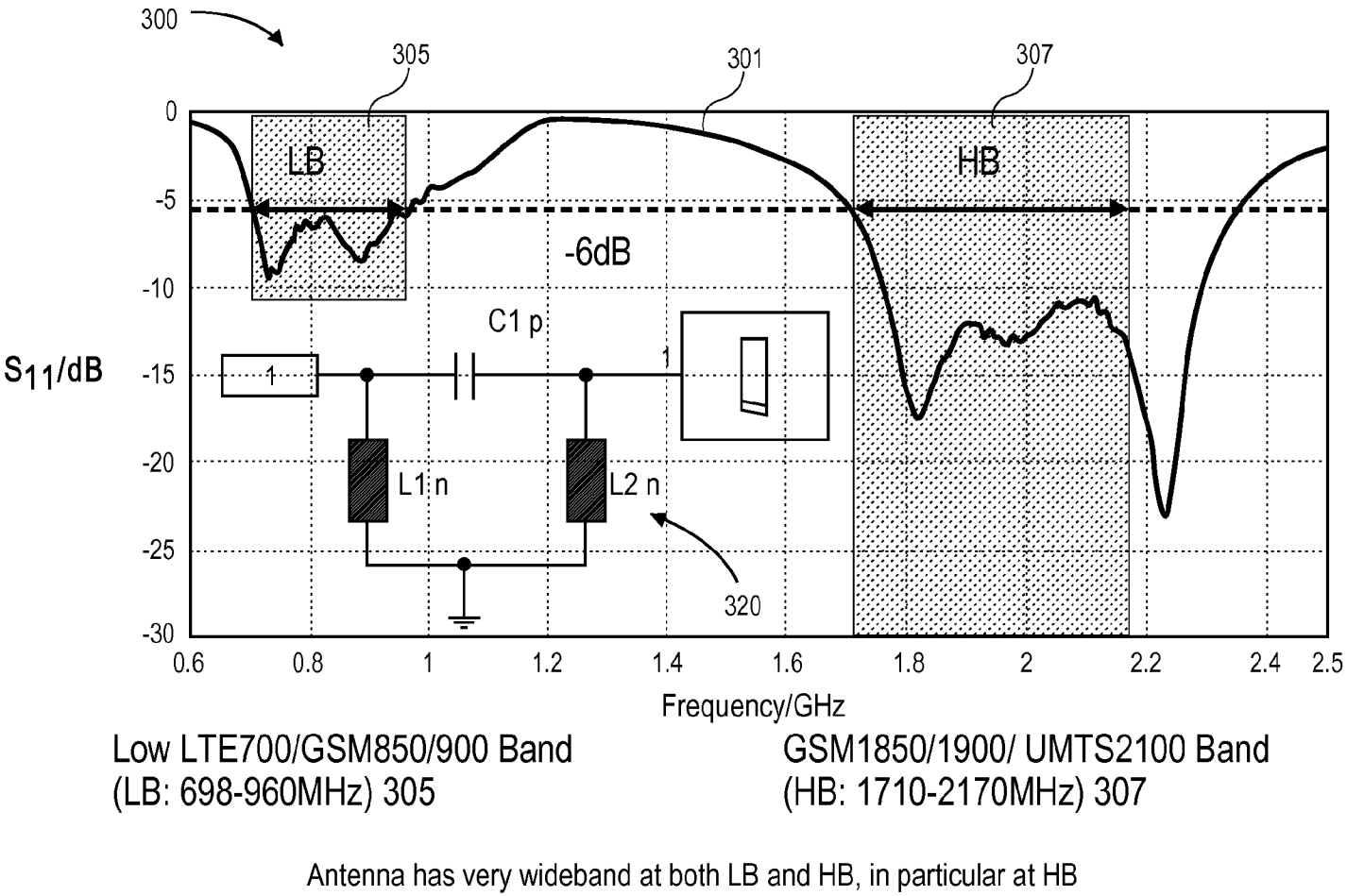
FIG. 3 is a graph of measured reflection coefficient of the quad-mode antenna of FIG. 1 according to one embodiment.

FIG. 3 is a graph 300 of measured reflection coefficient of the quad-mode antenna of FIG. 1 according to one embodiment. The graph 300 shows the measured reflection coefficient (also referred to S-parameter or |S11|) 301 of the structure of the quad-mode antenna 100 of FIG. 1 with an impedance matching circuit 320. The impedance matching circuit 320 may be used to accommodate for the reflection coefficient at a low band (LB) 305. In one embodiment, the LB 305 covers a frequency range of 698-960 MHz, such as for the LTE700/GSM850/900 bands. Alternatively, other frequencies in the LB 305 may be covered by the quad-mode antenna 100. As illustrated in FIG. 3, the impedance matching circuit 320 includes two inductors and a capacitor. The output of the impedance matching circuit 320 is coupled to the RF feed 142. The input of the impedance matching circuit 320 may be coupled to an output of the modem or other antenna circuitry. In one embodiment, the impedance matching circuit 320 is disposed on a PCB. In one embodiment, the capacitor has a value of 2 pF and the inductors have values of 13 nH and 8 nH. Alternatively, other capacitor or inductor values may be used as would be appreciated by one of ordinary skill in the art having the benefit of this disclosure.

In one embodiment, there is a phenomenon with the 0.5λ folded monopole antenna at the LB 305 that the reflection coefficient is not adequate since its impedance is four times of that of a monopole antenna, resulting in the high input impedance. The impedance matching circuit 320, shown in FIG. 3, may be a high pass "π" network. It is interesting to note from the Smith chart of FIG. 4 that not only does the impedance matching circuit 320 transfer the high impedance at the LB 305 close to 50Ω, but it also improves the impedance matching at a high band (HB) 307. In one embodiment, the HB 307 covers a frequency range of 1.71-2.17 GHz, such as for the GSM1850/1900/UMTS2100 bands. Alternatively, other frequencies in the HB 307 may be covered by the quad-mode antenna 100. This is because the impedance matching circuit 320 performs as a series capacitor at the HB 307. Most importantly, the antenna's impedance locus of points at the HB 307 may be intentionally designed to locate around the inductive region on the Smith chart, illustrated in FIG. 4. Referring back to FIG. 3, the quad-mode antenna 100 has a good reflection coefficient at both LB 305 and HB 307 and it can meet a negative 6 dB reflection coefficient requirement, a typical value requirement for a commercial terminal device. The embodiment of FIG. 3 illustrates an absolute magnitude reflection coefficient and the impedance matching circuit 320 has the following inductances and capacitance: L1=11 nH, L2=16 nH and C1=1.8 pF. Alternatively, the impedance matching circuit 320 may have other values for the inductances and capacitance as would be appreciated by one of ordinary skill in the art having the benefit of this disclosure.

Figure 4:
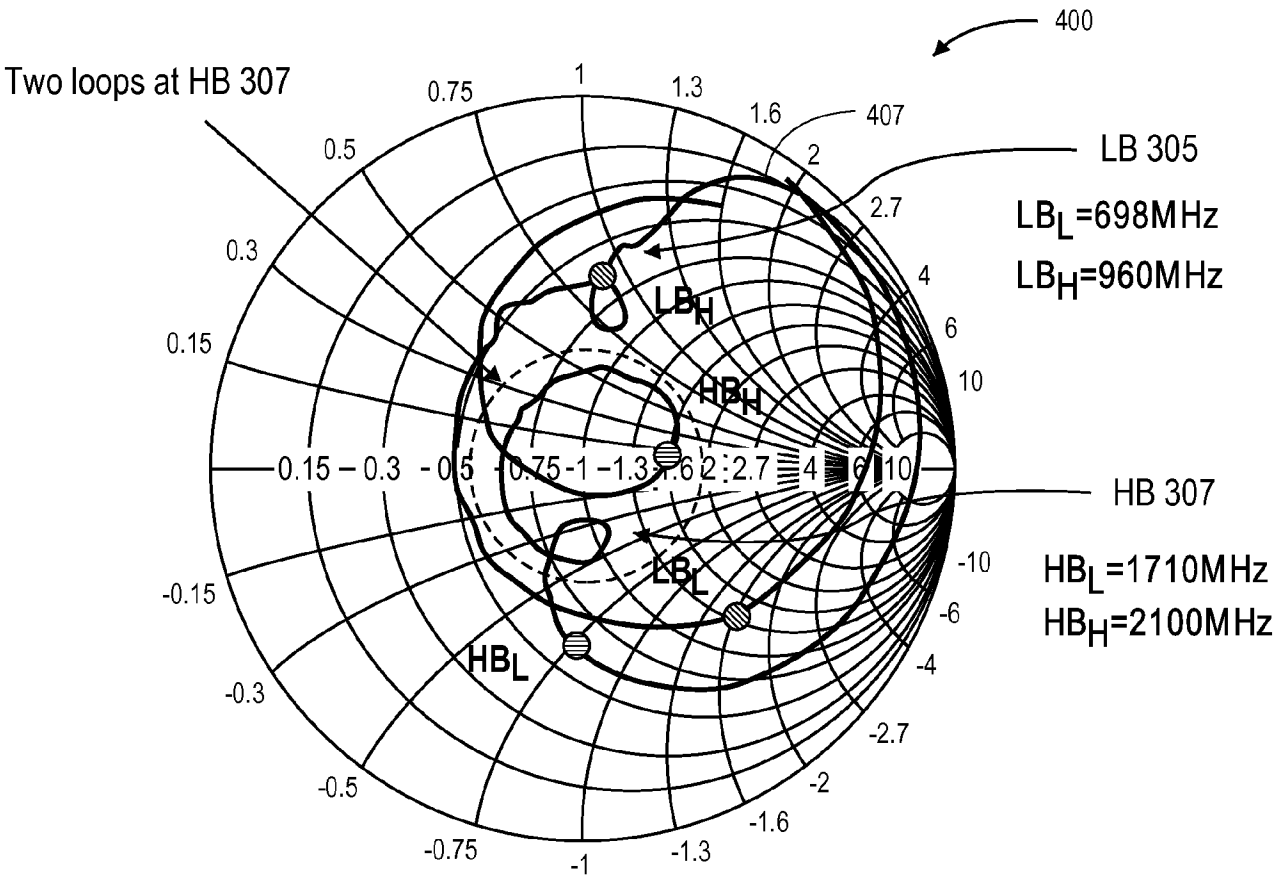
FIG. 4 is a Smith chart of an input impedance of the quad-mode antenna of FIG. 1 according to one embodiment.

FIG. 4 is a Smith chart 400 of an input impedance of the quad-mode antenna 100 of FIG. 1 according to one embodiment. The Smith chart 400 illustrates how the impedance and reactance behave at one or more frequencies for the quad-mode antenna 100. In particular, the line 407 corresponds to the impedance of the quad-mode antenna 100 with the impedance matching circuit 320. The Smith chart 400 illustrates the quad-mode antenna 100 as having three resonant modes at the HB 307 as the locus of antenna input impedance on the Smith chart as identified as the two loops at the HB 307. The Smith chart 400 also illustrates the quad-mode antenna 100 as having resonant mode at the LB 305.

FIGS. 5A-5D illustrate surface currents in four modes of the quad-mode antenna 100 of FIG. 1 according to one embodiment. In order to distinguish these resonances, vector surface current distributions of the antenna structure 120 at frequencies of 900, 1700, 1900 and 2300 MHz are plotted in FIGS. 5A-5D. From FIGS. 5A-5C, it can be seen that the resonances at the frequencies of 900, 1700 and 1900 MHz are folded monopole 2×¼λ (0.5λ) & 2×¾λ (1.5λ) and folded dipole 2×½λ (1λ) modes. In particular, the distributions of the surface currents have the following characteristics: in FIG. 5A, the antenna structure 120 operates in a first mode 500 as 2×¼λ folded monopole at f=900 MHz; in FIG. 5B, the antenna structure 120 operates in a second mode 520 as 2×¾λ folded monopole at f=1700 MHz; and in FIG. 5C, the antenna structure 120 operates in a third mode 540 as 2×½λ folded dipole at f=1900 MHz. These modes 500, 520, and 540 are generated when two monopoles of a ¼λ & a ¾λ mode and two dipoles of a ½λ mode join at their respective minimum current regions where the vector currents change their directions. It should be noted that a solid line in the distribution represents a ¼λ monopole element and a double solid line represents a ½λ dipole element.

Figure 5A:
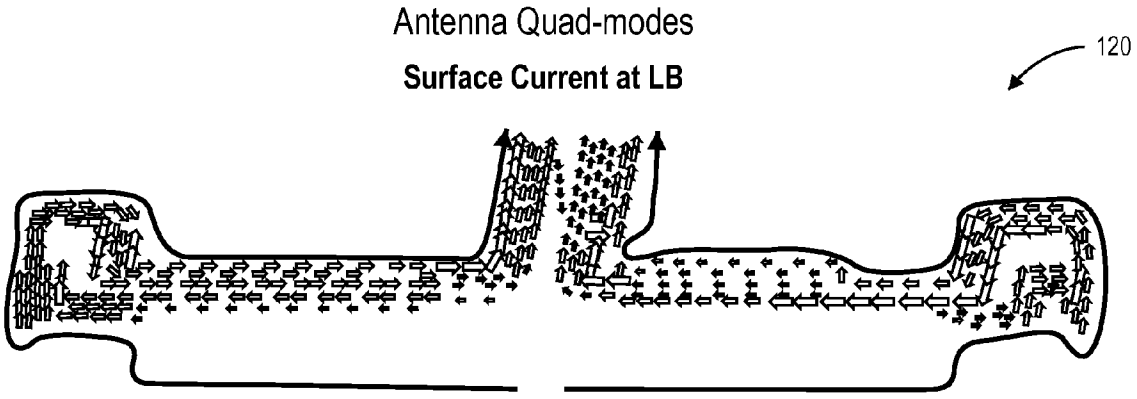
FIGS. 5A-5D illustrate surface current in four modes of the quad-mode antenna of FIG. 1 according to one embodiment.
Figure 5B:
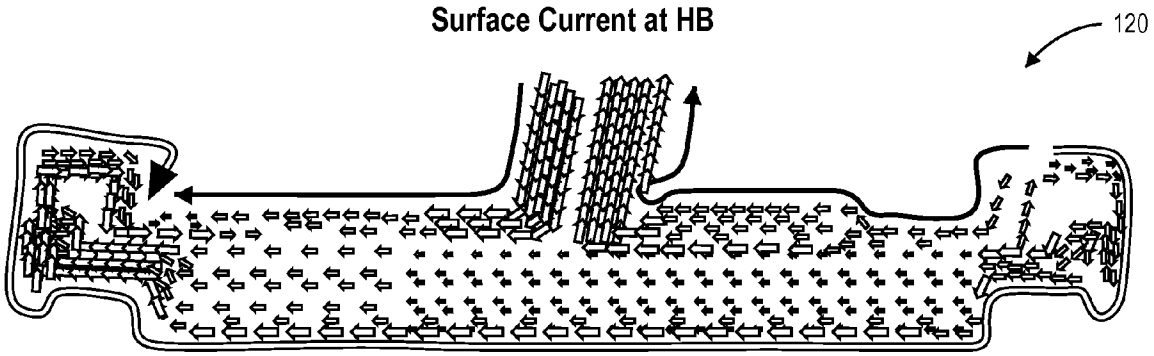
Figure 5C:
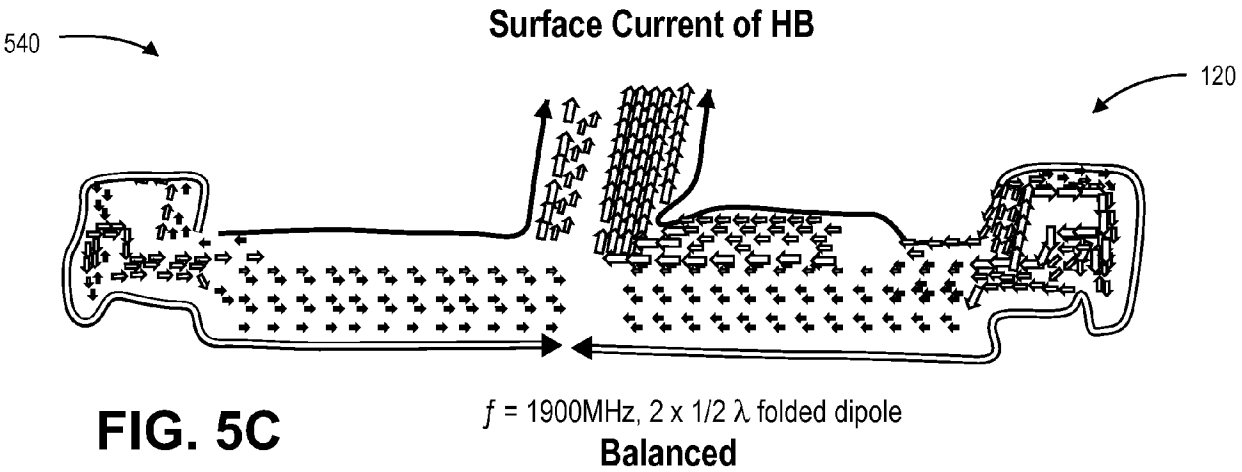
Figure 5D:
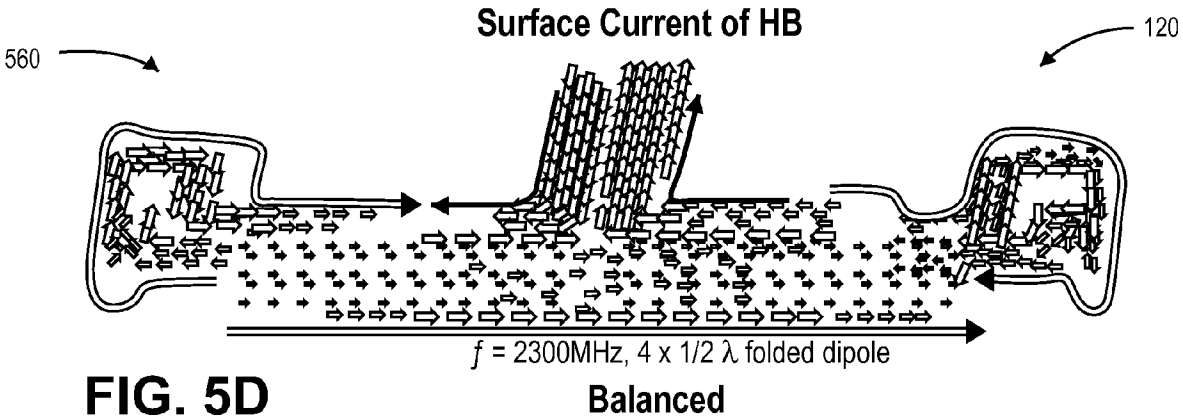
Figure 6A:
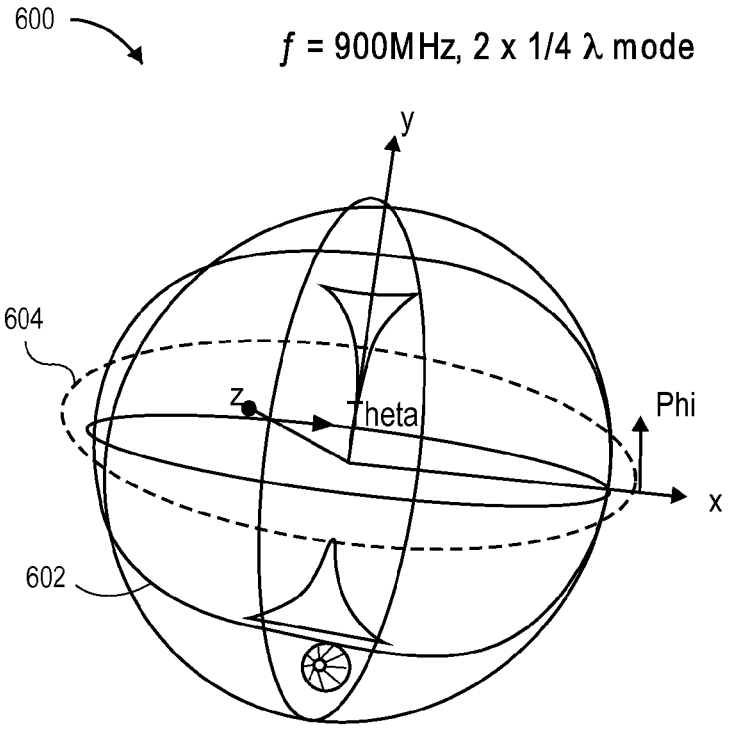
FIGS. 6A-6D are simulated antenna 3D radiation patterns at frequencies of 900, 1700, 1900 and 2300 MHz, respectively according to one embodiment.
Figure 6B:
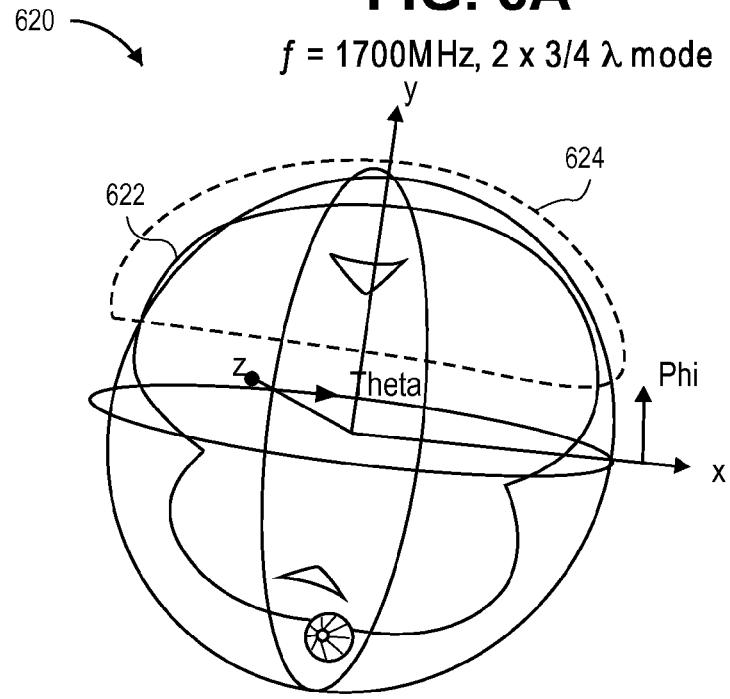
Figure 6C:
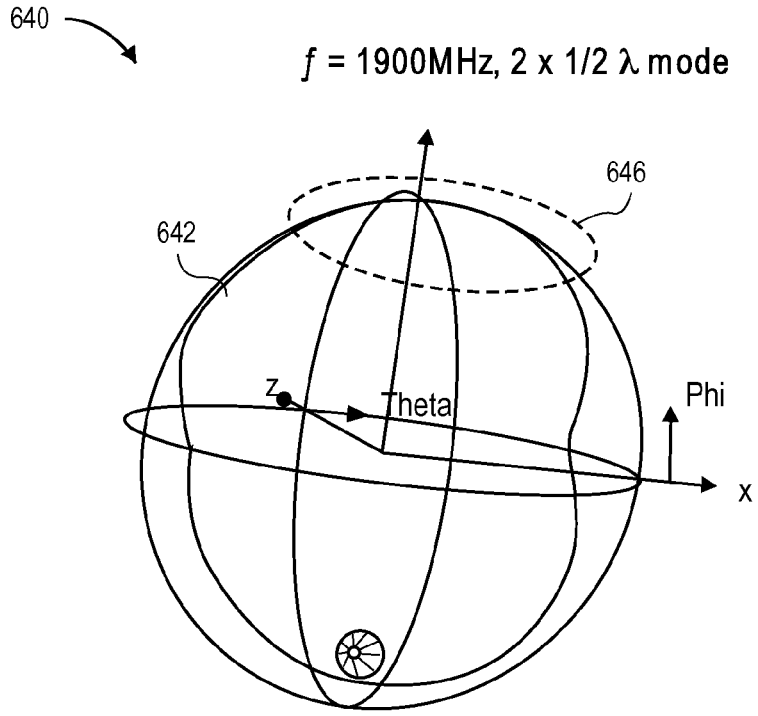
Figure 6D:
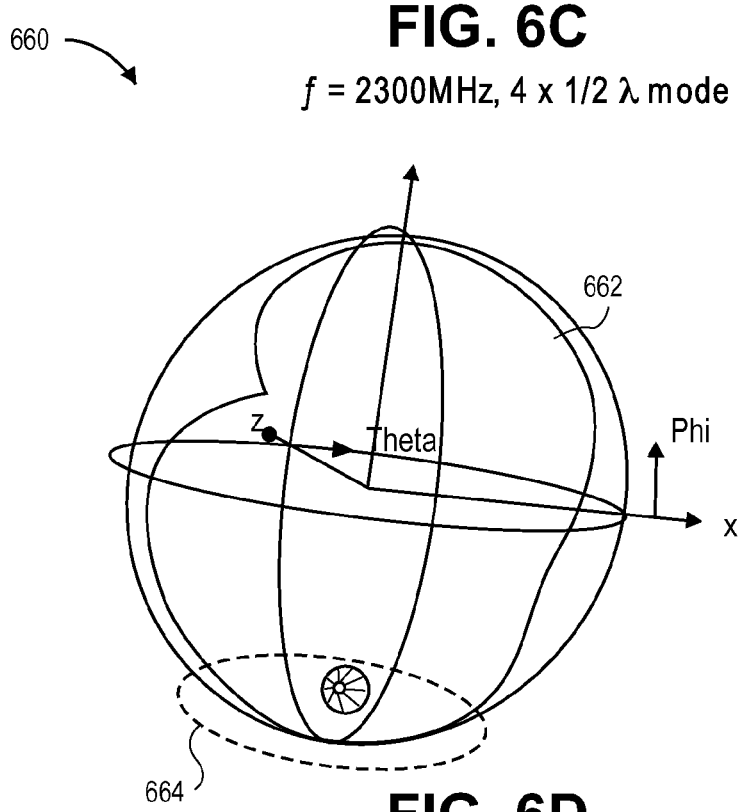

By further examining the surface current distribution at the frequency of 2.3 GHz illustrated in FIG. 5D, there are four ½λ dipoles which connect at their minimum current regions via the "head to head and tail to tail" manner. This indicates that a fourth mode 560 at f=2300 MHz is a balanced high-order folded dipole 4×½λ (2λ) mode. The surface current distribution indicates that the antenna structure 120 provides a unique 2λ mode that can be excited and utilized to extend the resonant modes, as well as the frequency ranges covered by the antenna structure 120. The fourth mode 560 can be employed together with other resonant modes to cover a wide cellular HB in a contiguous manner as shown in the Smith chart of FIG. 4.

FIGS. 6A-6D are simulated antenna 3D radiation patterns at frequencies of 900, 1700, 1900 and 2300 MHz, respectively according to one embodiment. It can be seen from FIGS. 6A-6B that the radiation patterns 600 and 620 at frequencies of 900 and 1700 MHz are typical "donut" and "double donut" shapes, respectively. This is because the antenna structure 120 and the PCB at f=900 MHz behave as a 2×¼λ dipole (the antenna element is one part of ¼λ monopole and the PCB is the other part of ~¼λ monopole), whilst at f=1700 MHz, they operate as a 2×¾λ dipole. For example, the antenna structure 120 is one part of ¾λ monopole and the PCB is the other part of ~¾λ monopole. The "double donut" radiation pattern may result from the relatively large aperture of the radiating elements of the antenna structure 120 and PCB at f=1700 MHz. More specifically, the radiation pattern 600 has a donut shape 602 with a higher magnitude in terms of dBi in the area 604, and the radiation pattern 620 has a double donut shape 622 with a higher magnitude in terms of dBi in the area 624. From FIGS. 6C-6D, it can be seen that both the antenna patterns 640 and 660 at f=1900 MHz and 2300 MHz are of asymmetrical distorted donut-like shapes. More specifically, the radiation pattern 640 has a distorted donut shape 642 with a higher magnitude in terms of dBi in the area 644, and the radiation pattern 660 has a double donut shape 662 with a higher magnitude in terms of dBi in the area 664. However, their main axes are nearly at the x-axis direction compared to that at the y-axis at f=900 MHz and 1700 MHz. The reason for that is the main radiation sources are from the antenna structure 120, rather than from the PCB, since the antenna structure 120 operates as balanced 1λ and 2λ dipoles, respectively, which are placed and polarized horizontally. In addition, there is much less current excited on the PCB compared to that of the antenna structure 120 due the self-balanced nature of the folded dipole modes as shown in FIGS. 5C-5D. In short, the radiation patterns have the following characteristics: the first radiation pattern 600 of 2×¼λ mode at f=900 MHz; the second radiation pattern 620 of 2×¾λ mode at f=1700 MHz; the third radiation pattern 640 of 2×½λ mode at f=1900 MHz; and the fourth radiation pattern 660 4×½λ mode at f=2300 MHz.

Figure 7:
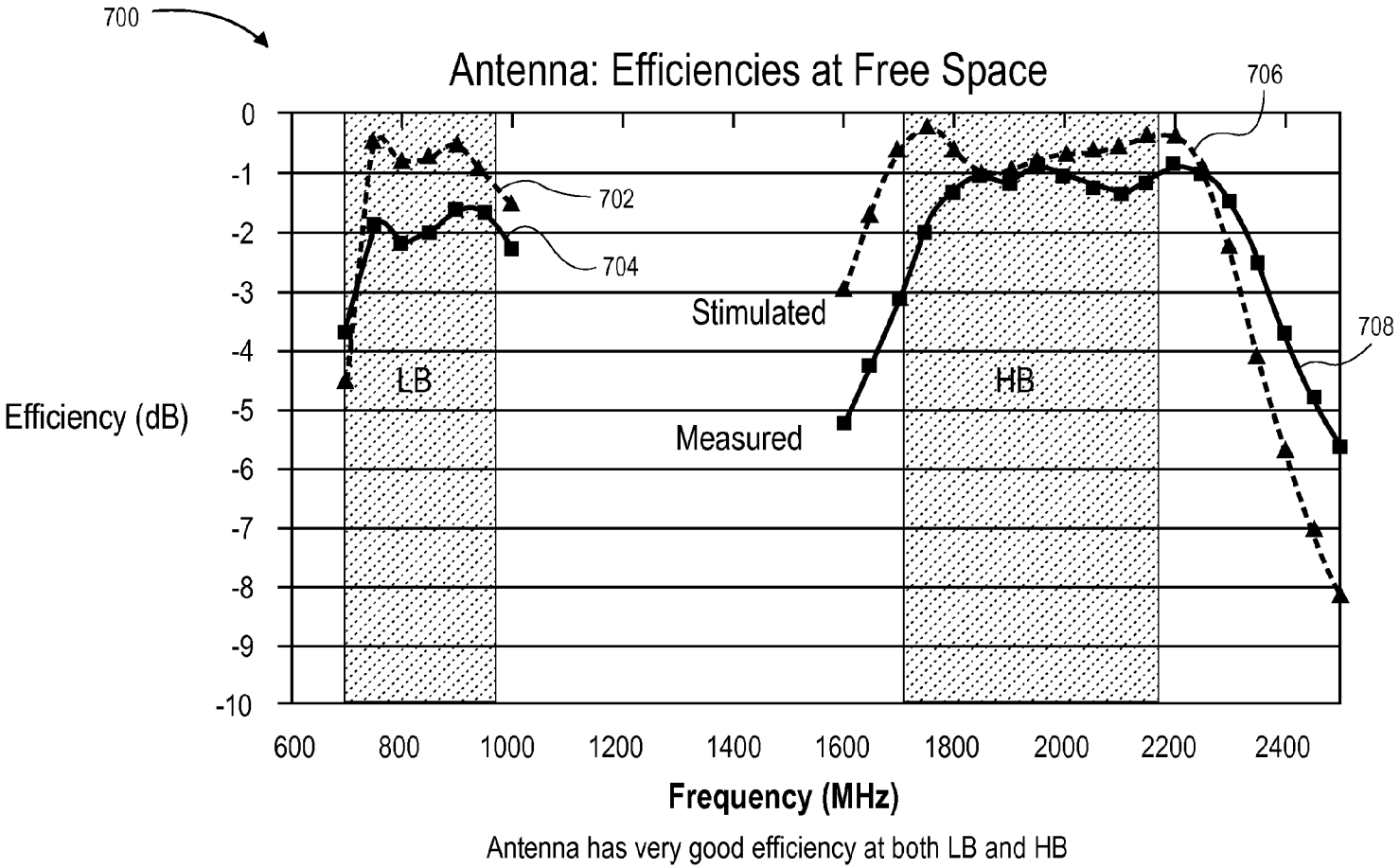
FIG. 7 is a graph of efficiencies of the quad-mode antenna of FIG. 1 in free space according to one embodiment.

FIG. 7 is a graph 700 of efficiencies of the quad-mode antenna of FIG. 1 in free space according to one embodiment. The total efficiency of the antenna can be measured by including the loss of the structure and mismatch loss. The graph 700 shows the simulated efficiency 702 and the measured efficiency 704 of the antenna structure 120 in the LB (e.g., 305). The graph 700 also shows the simulate efficiency 706 and the measured efficiency 708 of the antenna structure 120 in the HB (e.g., 307). In the depicted embodiment, the simulated and measured efficiencies 702 and 704 are good between 700 and 960 MHz, and the simulated and measured efficiencies 706 and 708 are good between 1.71 GHz and 2.2. GHZ. The efficiencies 702-708 are the efficiencies of the antenna structure's efficiencies at free space (FS). It should be noted that the efficiencies 702-708 are also good outside of the LB and HB, especially in the HB.

Figure 8:
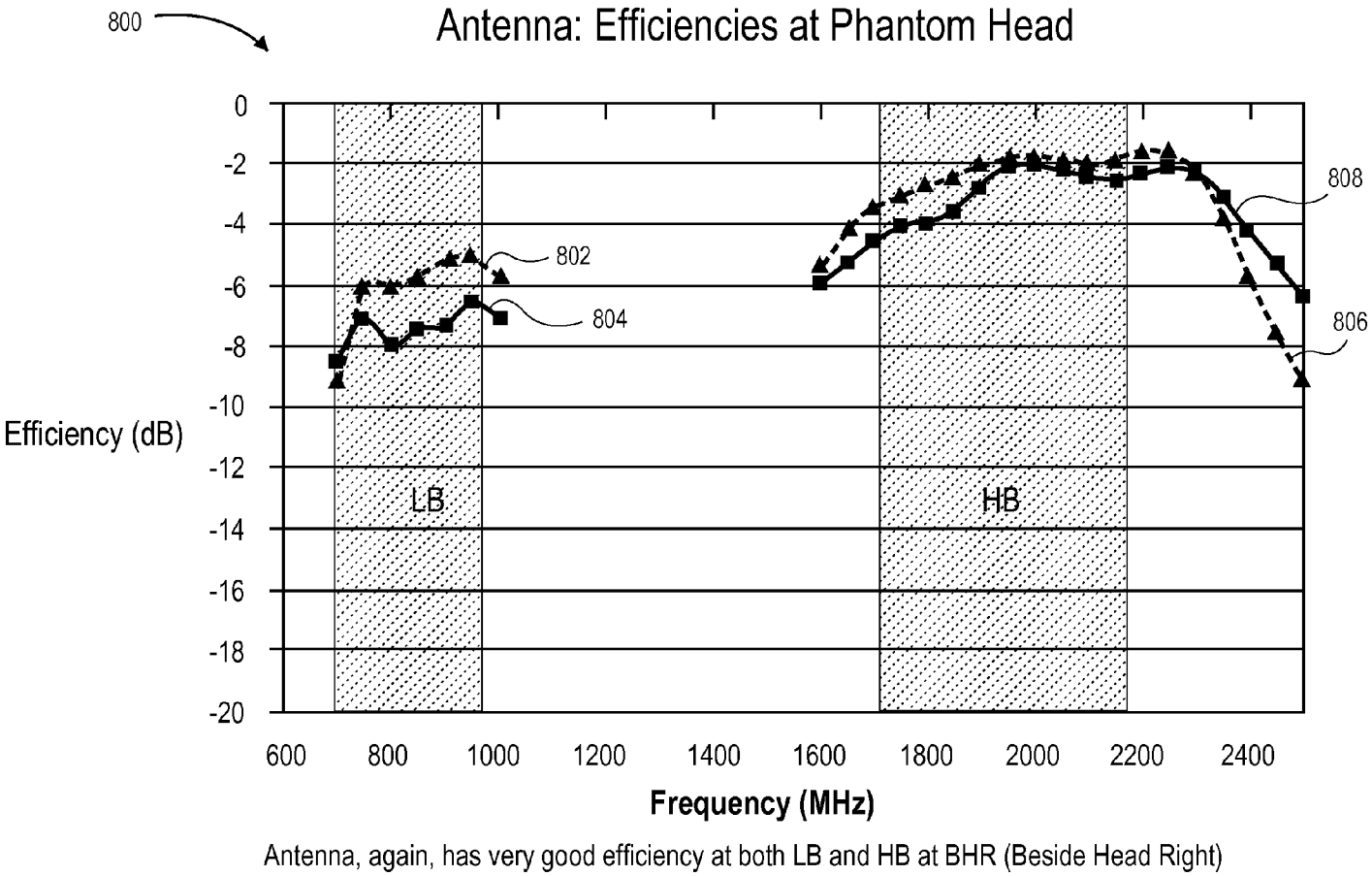
FIG. 8 is a graph of efficiencies of the quad-mode antenna of FIG. 1 with a phantom head according to one embodiment.

FIG. 8 is a graph 800 of efficiencies of the quad-mode antenna of FIG. 1 with a phantom head according to one embodiment. In particular, FIG. 8 is the antenna structure's radiated efficiency at Beside Head Right (BHR). The graph 800 shows the simulated efficiency 802 and the measured efficiency 804 of the antenna structure 120 in the LB (e.g., 305). The graph 800 also shows the simulate efficiency 806 and the measured efficiency 808 of the antenna structure 120 in the HB (e.g., 307). In the depicted embodiment, the simulated and measured efficiencies 802 and 804 are good between 698 and 960 MHz, and the simulated and measured efficiencies 806 and 808 are good between 1.71 GHz and 2.2. GHZ. It should be noted that the efficiencies 802-808 are also good outside of the LB and HB, especially in the HB.

Figure 9:
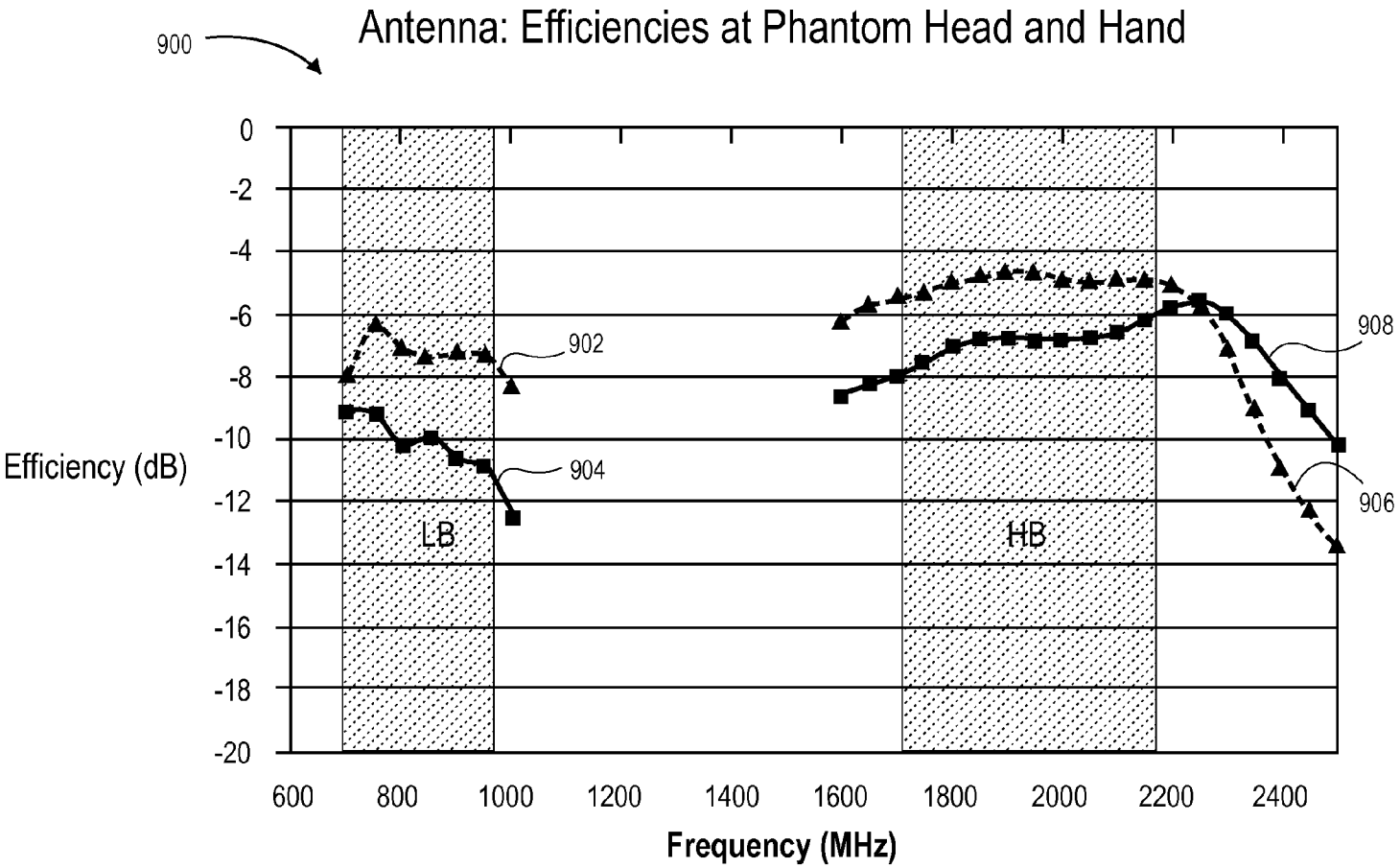
FIG. 9 is a graph of efficiencies of the quad-mode antenna of FIG. 1 with a phantom head according to another embodiment.

FIG. 9 is a graph of efficiencies of the quad-mode antenna of FIG. 1 with a phantom head according to another embodiment. In particular, FIG. 9 is the antenna structure's radiated efficiency at Beside Head and Hand Right (BHHR). The graph 900 shows the simulated efficiency 902 and the measured efficiency 904 of the antenna structure 120 in the LB (e.g., 305). The graph 800 also shows the simulate efficiency 906 and the measured efficiency 908 of the antenna structure 120 in the HB (e.g., 307). In the depicted embodiment, the simulated and measured efficiencies 902 and 904 are good between 698 and 960 MHz, and the simulated and measured efficiencies 906 and 908 are good between 1.71 GHz and 2.2. GHZ. It should be noted that the efficiencies 902-908 are also good outside of the LB and HB, especially in the HB.

It illustrates in FIG. 7 that the antenna has average FS efficiencies of ~−2.2 dB (60%) and −1.3 dB (73%) at the LB and HB, respectively, which are reasonable values for a typical communication device. The BHR and BHHR figures are shown in FIGS. 8-9, which are equally satisfactory. One embodiment of the simulated efficiency is also presented in FIG. 7 from which it can be seen that reasonably agreement is obtained between measured and simulated results. The small discrepancy may be attributed to the chamber's accuracy, prototype cable's effect, and deviation of the prototype from the simulated model including the tolerances of the fabricated antenna and matching components as well as the capability of the simulation software as would be appreciated by one of ordinary skill in the art having the benefit of this disclosure.

Figure 10:
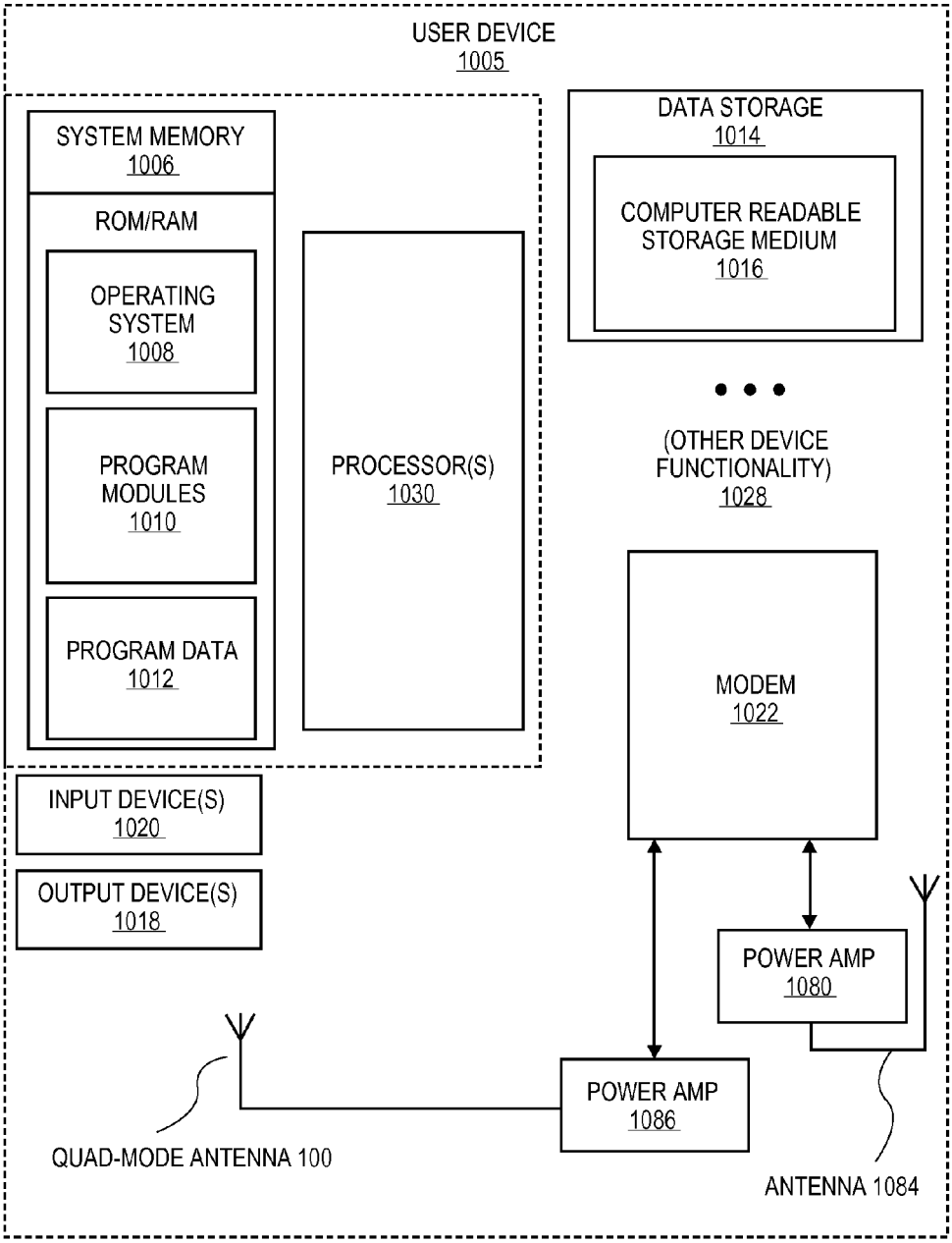
FIG. 10 is a block diagram of a user device having a quad-mode antenna according to one embodiment.

FIG. 10 is a block diagram of a user device 1005 having the quad-mode antenna 100 of FIG. 1 according to one embodiment. The user device 1005 includes one or more processors 1030, such as one or more CPUs, microcontrollers, field programmable gate arrays, or other types of processing devices. The user device 1005 also includes system memory 1006, which may correspond to any combination of volatile and/or non-volatile storage mechanisms. The system memory 1006 stores information, which provides an operating system component 1008, various program modules 1010, program data 1012, and/or other components. The user device 1005 performs functions by using the processor(s) 1030 to execute instructions provided by the system memory 1006.

The user device 1005 also includes a data storage device 1014 that may be composed of one or more types of removable storage and/or one or more types of non-removable storage. The data storage device 1014 includes a computer-readable storage medium 1016 on which is stored one or more sets of instructions embodying any one or more of the functions of the user device 1005, as described herein. As shown, instructions may reside, completely or at least partially, within the computer readable storage medium 1016, system memory 1006 and/or within the processor(s) 1030 during execution thereof by the user device 1005, the system memory 1006 and the processor(s) 1030 also constituting computer-readable media. The user device 1005 may also include one or more input devices 1020 (keyboard, mouse device, specialized selection keys, etc.) and one or more output devices 1018 (displays, printers, audio output mechanisms, etc.).

The user device 1005 further includes a wireless modem 1022 to allow the user device 1005 to communicate via a wireless network (e.g., such as provided by a wireless communication system) with other computing devices, such as remote computers, an item providing system, and so forth. The wireless modem 1022 allows the user device 1005 to handle both voice and non-voice communications (such as communications for text messages, multimedia messages, media downloads, web browsing, etc.) with a wireless communication system. The wireless modem 1022 may provide network connectivity using any type of digital mobile network technology including, for example, cellular digital packet data (CDPD), general packet radio service (GPRS), enhanced data rates for GSM evolution (EDGE), UMTS, 1 times radio transmission technology (1×RTT), evaluation data optimized (EVDO), high-speed downlink packet access (HSDPA), WiFi, etc. In other embodiments, the wireless modem 1022 may communicate according to different communication types (e.g., WCDMA, GSM, LTE, CDMA, WiMax, etc) in different cellular networks. The cellular network architecture may include multiple cells, where each cell includes a base station configured to communicate with user devices within the cell. These cells may communicate with the user devices 1005 using the same frequency, different frequencies, same communication type (e.g., WCDMA, GSM, LTE, CDMA, WiMax, etc), or different communication types. Each of the base stations may be connected to a private, a public network, or both, such as the Internet, a local area network (LAN), a public switched telephone network (PSTN), or the like, to allow the user devices 1005 to communicate with other devices, such as other user devices, server computing systems, telephone devices, or the like. In addition to wirelessly connecting to a wireless communication system, the user device 1005 may also wirelessly connect with other user devices. For example, user device 1005 may form a wireless ad hoc (peer-to-peer) network with another user device.

The wireless modem 1022 may generate signals and send these signals to power amplifier (amp) 1080 or power amp 1086 for amplification, after which they are wirelessly transmitted via the quad-mode antenna 100 or antenna 1084, respectively. Although FIG. 10 illustrates power amps 1080 and 1086, in other embodiments, a transceiver may be used to all the antennas 110 and 1084 to transmit and receive. The antenna 1084, which is an optional antenna that is separate from the quad-mode antenna 100, may be any directional, omnidirectional, or non-directional antenna in a different frequency band than the frequency bands of the quad-mode antenna 100. The antenna 1084 may also transmit information using different wireless communication protocols than the quad-mode antenna 100. In addition to sending data, the quad-mode antenna 100 and the antenna 1084 also receive data, which is sent to wireless modem 1022 and transferred to processor(s) 1030. It should be noted that, in other embodiments, the user device 1005 may include more or less components as illustrated in the block diagram of FIG. 10.

In one embodiment, the user device 1005 establishes a first connection using a first wireless communication protocol, and a second connection using a different wireless communication protocol. The first wireless connection and second wireless connection may be active concurrently, for example, if a user device is downloading a media item from a server (e.g., via the first connection) and transferring a file to another user device (e.g., via the second connection) at the same time. Alternatively, the two connections may be active concurrently during a handoff between wireless connections to maintain an active session (e.g., for a telephone conversation). Such a handoff may be performed, for example, between a connection to a WiFi hotspot and a connection to a wireless carrier system. In one embodiment, the first wireless connection is associated with a first resonant mode of the quad-mode antenna 100 that operates at a first frequency band and the second wireless connection is associated with a second resonant mode of the quad-mode antenna 100 that operates at a second frequency band. In another embodiment, the first wireless connection is associated with the quad-mode antenna 100 and the second wireless connection is associated with the antenna 1084. In other embodiments, the first wireless connection may be associated with a media purchase application (e.g., for downloading electronic books), while the second wireless connection may be associated with a wireless ad hoc network application. Other applications that may be associated with one of the wireless connections include, for example, a game, a telephony application, an Internet browsing application, a file transfer application, a global positioning system (GPS) application, and so forth.

Though a single modem 1022 is shown to control transmission to both antennas 110 and 1084, the user device 1005 may alternatively include multiple wireless modems, each of which is configured to transmit/receive data via a different antenna and/or wireless transmission protocol. In addition, the user device 1005, while illustrated with two antennas 110 and 1084, may include more or fewer antennas in various embodiments.

The user device 1005 delivers and/or receives items, upgrades, and/or other information via the network. For example, the user device 1005 may download or receive items from an item providing system. The item providing system receives various requests, instructions, and other data from the user device 1005 via the network. The item providing system may include one or more machines (e.g., one or more server computer systems, routers, gateways, etc.) that have processing and storage capabilities to provide the above functionality. Communication between the item providing system and the user device 1005 may be enabled via any communication infrastructure. One example of such an infrastructure includes a combination of a wide area network (WAN) and wireless infrastructure, which allows a user to use the user device 1005 to purchase items and consume items without being tethered to the item providing system via hardwired links. The wireless infrastructure may be provided by one or multiple wireless communications systems, such as one or more wireless communications systems. One of the wireless communication systems may be a wireless fidelity (WiFi) hotspot connected with the network. Another of the wireless communication systems may be a wireless carrier system that can be implemented using various data processing equipment, communication towers, etc. Alternatively, or in addition, the wireless carrier system may rely on satellite technology to exchange information with the user device 1005.

The communication infrastructure may also include a communication-enabling system that serves as an intermediary in passing information between the item providing system and the wireless communication system. The communication-enabling system may communicate with the wireless communication system (e.g., a wireless carrier) via a dedicated channel, and may communicate with the item providing system via a non-dedicated communication mechanism, e.g., a public Wide Area Network (WAN) such as the Internet.

The user devices 1005 are variously configured with different functionality to enable consumption of one or more types of media items. The media items may be any type of format of digital content, including, for example, electronic texts (e.g., eBooks, electronic magazines, digital newspapers, etc.), digital audio (e.g., music, audible books, etc.), digital video (e.g., movies, television, short clips, etc.), images (e.g., art, photographs, etc.), and multi-media content. The user devices 1005 may include any type of content rendering devices such as electronic book readers, portable digital assistants, mobile phones, laptop computers, portable media players, tablet computers, cameras, video cameras, netbooks, notebooks, desktop computers, gaming consoles, DVD players, media centers, and the like.

Figure 11:
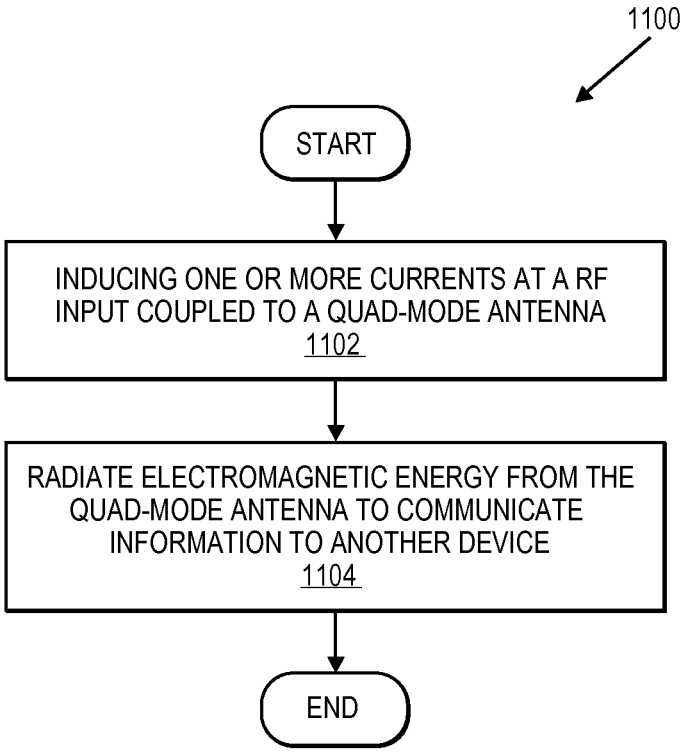
FIG. 11 is a flow diagram of an embodiment of a method of operating a user device having a quad-mode antenna according to one embodiment.

FIG. 11 is a flow diagram of an embodiment of a method 1100 of operating a user device having a quad-mode antenna according to one embodiment. In method 1100, one or more currents are induced at a single radio frequency (RF) input coupled to a quad-mode antenna (block 1102). In response to the one or more currents, the quad-mode antenna radiates electromagnetic energy to communicate information to another device (block 1104). The electromagnetic energy forms a radiation pattern. The radiation pattern may be various shapes as would be appreciated by one of ordinary skill in the art having the benefit of this disclosure.

In one embodiment, a current is induced at the RF input, which induces a surface current flow of the quad-mode antenna. The surface current can be driven to produce four resonant modes as described herein.

The embodiments described herein can be used as a hexa-band folded/monopole/dipole/loop antenna with four resonant modes. The quad-mode antenna can provide an extra balanced 2λ mode which, together with other known 0.5λ, 1λ and 1.5λ modes, can be utilized to cover wide cellular bands including the LTE700/GSM850/900 band (698-960 MHz) and GSM1850/1900/UMTS2100 (1710-2170 MHz) band. These four modes, in particular, two unique 1λ and 2λ balanced modes, could offer valuable advantages over unbalanced PIFA and monopole antennas. The quad-mode antenna may be used to mitigate end users' effects due to the close proximity between users' hands & heads and handhold devices with embedded antennas. For example, the proposed antenna may be employed to reduce Specific Absorption Rate (SAR), satisfy Hearing Aid Compatibility (HAC) requirements and enhance users' experience due to the improved Over The Air (OTA) performance. It should be, however, noted that the folded/monopole/dipole/loop antenna with this distinctive balanced feature also carries its own penalties. For example, the quad-mode antenna may be larger by comparison with conventional unbalanced PFIA and monopole antennas.

In the above description, numerous details are set forth. It will be apparent, however, to one of ordinary skill in the art having the benefit of this disclosure, that embodiments of the present invention may be practiced without these specific details. In some instances, well-known structures and devices are shown in block diagram form, rather than in detail, in order to avoid obscuring the description.

Some portions of the detailed description are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "inducing," "parasitically inducing," "radiating," "detecting," determining," "generating," "communicating," "receiving," "disabling," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the present invention also relate to an apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

The algorithms and displays presented herein are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein. It should also be noted that the terms "when" or the phrase "in response to," as used herein, should be understood to indicate that there may be intervening time, intervening events, or both before the identified operation is performed.

It is to be understood that the above description is intended to be illustrative, and not restrictive. Many other embodiments will be apparent to those of skill in the art upon reading and understanding the above description. The scope of the present invention should, therefore, be determined with reference to the appended claims, along with the full scope of equivalents to which such claims are entitled.

What is claimed is:

1. A user device comprising:

a circuit board comprising a transceiver and a ground plane, wherein the transceiver is configured to output radio frequency (RF) signals;

an antenna carrier comprising a top surface, a first side, a second side, a front surface, and a back surface;

an antenna structure disposed on the antenna carrier, wherein:

the antenna structure comprises a continuous loop element disposed on the antenna carrier and coupled between a feeding point that is configured to receive the RF signals and a grounding point coupled to the ground plane, wherein the continuous loop element comprises:

a first portion that perpendicularly extends along the back surface of the antenna carrier from the feeding point and away from the ground plane;

a second portion that extends along the top surface of the antenna carrier from a bend at a distal end of the first portion and towards the first side of the antenna carrier;

a third portion that wraps along an edge of the first side, wherein:

a first section of the third portion extends from the second portion and is disposed on the top surface of the antenna carrier, a second section of the third portion extends from the first section of the third portion to fold from the top surface of the antenna carrier to the first side of the antenna carrier, and a third section of the third portion extends from the second section of the third portion to fold from the first side of the antenna carrier to the top surface of the antenna carrier; and a fourth portion that wraps along an edge of the front surface, wherein:

a first section of the fourth portion extends from the third portion and is disposed on the top surface of the antenna carrier, a second section of the fourth portion extends from the first section of the fourth portion to fold from the top surface of the antenna carrier to the front surface of the antenna carrier, and a third section of the fourth portion extends from the second section of the fourth portion to fold from the front surface of the antenna carrier to the top surface of the antenna carrier; and the antenna structure is configured to radiate electromagnetic energy in four resonant modes in response to the RF signals.

2. The user device of claim 1, wherein the continuous loop element is configured to radiate electromagnetic energy in at least three standard wireless frequency bands.

3. The user device of claim 1, wherein the continuous loop element is configured to radiate electromagnetic energy in six standard wireless frequency bands.

4. The user device of claim 1, wherein the four resonant modes comprise a 0.5 wavelength (λ) mode, a 1λ mode, a 1.5λ mode, and a 2λ mode.

5. The user device of claim 1, wherein the continuous loop element is configured to radiate at 0.5 wavelength (λ) in a first mode of the four resonant modes, at 1λ in a second mode of the four resonant modes, at 1.5λ in a third mode of the four resonant modes, and at a 2λ in a fourth mode of the four resonant modes.

6. The user device of claim 1, wherein the continuous loop element is configured to operate as a first folded monopole antenna in an unbalanced two quarter-wavelength (λ) mode of the four resonant modes, wherein the continuous loop element is configured to operate as a second folded monopole antenna in an unbalanced two three-quarter-wavelength mode of the four resonant modes, wherein the continuous loop element is configured to operate as a third folded dipole antenna in a balanced two half-wavelength mode of the four resonant modes, and wherein the continuous loop element is configured to operate as a fourth folded dipole antenna in a balanced four half-wavelength mode of the four resonant modes.

7. The user device of claim 1, wherein the continuous loop element comprises:

a fifth portion that extends along the second side of the antenna carrier, wherein:

a first section of the fifth portion extends from the fourth portion and is disposed on a top surface of the antenna carrier, a second section of the fifth portion extends from the first section of the fifth portion to fold from the top surface of the antenna carrier to the second side of the antenna carrier, and a third section of the fifth portion extends from the second section of the fifth portion to fold from the second side of the antenna carrier to the top surface of the antenna carrier;

a sixth portion that extends from the fifth portion towards the first side; and a seventh portion that perpendicularly extends from a bend at a distal end of the sixth portion towards the grounding point of the ground plane.

8. An apparatus comprising:

a single radio frequency (RF) input;

an antenna carrier comprising a top surface, a first side, a second side, a front surface, and a back surface; and an antenna coupled to the single RF input, wherein the antenna comprises a loop element coupled to the single RF input and ground-and is configured to operate in four resonant modes to radiate electromagnetic energy in response to the single RF input, wherein the loop element comprises:

a first portion that perpendicularly extends along the back surface of the antenna carrier from a feeding point and away from a ground plane;

a second portion that extends along the top surface of the antenna carrier from a bend at a distal end of the first portion and towards the first side of an antenna carrier;

a third portion that wraps along an edge of the first side, wherein:

a first section of the third portion extends from the second portion and is disposed on the top surface of the antenna carrier, a second section of the third portion extends from the first section of the third portion to fold from the top surface of the antenna carrier to the first side of the antenna carrier, and a third section of the third portion extends from the second section of the third portion to fold from the first side of the antenna carrier to the top surface of the antenna carrier; and a fourth portion that wraps along an edge of the front surface, wherein:

a first section of the fourth portion extends from the third portion and is disposed on the top surface of the antenna carrier, a second section of the fourth portion extends from the first section of the fourth portion to fold from the top surface of the antenna carrier to the front surface of the antenna carrier, and a third section of the fourth portion extends from the second section of the fourth portion to fold from the front surface of the antenna carrier to the top surface of the antenna carrier.

9. The apparatus of claim 8, wherein the four resonant modes comprise a 0.5 wavelength (λ) mode, a 1λ mode, a 1.5λ mode, and a 2λ mode.

10. The apparatus of claim 8, wherein the loop element is configured to radiate at 0.5 wavelength (λ) in a first mode of the four resonant modes, at 1λ in a second mode of the four resonant modes, at 1.5λ in a third mode of the four resonant modes, and at a 2λ in a fourth mode of the four resonant modes.

11. The apparatus of claim 8, wherein the loop element is configured to operate as a first folded monopole antenna in an unbalanced two quarter-wavelength mode of the four resonant modes, wherein the loop element is configured to operates as a second folded monopole antenna in an unbalanced two three-quarter-wavelength mode of the four resonant modes, wherein the loop element is configured to operates as a third folded dipole antenna in a balanced two half-wavelength mode of the four resonant modes, and wherein the loop element is configured to operates as a fourth folded dipole antenna in a balanced four half-wavelength mode of the four resonant modes.

12. The apparatus of claim 8, wherein the loop element is configured to radiate electromagnetic energy to cover a low band frequency range of 698 MHz to 960 MHz and a high band frequency range of 1710 MHz to 2350 MHz.

13. The apparatus of claim 8, wherein the loop element comprises:

a fifth portion that extends along the second side of the antenna carrier, wherein:

a first section of the fifth portion extends from the fourth portion and is disposed on a top surface of the antenna carrier, a second section of the fifth portion extends from the first section of the fifth portion to fold from the top surface of the antenna carrier to the second side of the antenna carrier, and a third section of the fifth portion extends from the second section of the fifth portion to fold from the second side of the antenna carrier to the top surface of the antenna carrier;

a sixth portion that extends from the fifth portion towards the first side; and a seventh portion that perpendicularly extends from a bend at a distal end of the sixth portion towards a grounding point of the ground plane.

14. The apparatus of claim 13, wherein the first portion comprises a first enlarged section that extends out from a longitudinal axis of the first portion to cause the first portion to be wider than other sections of the first portion, wherein the second portion comprises a second enlarged section that extends out from a longitudinal axis of the second portion to cause the second portion to be wider than other sections of the second portion, and wherein the third portion comprises a third enlarged section that extends out from a longitudinal axis of the third portion to cause the third portion to be wider than other sections of the third portion.

15. The apparatus of claim 14, wherein the third enlarged section is a close-coupled structure.

16. The apparatus of claim 8, wherein the loop element is configured to radiate the electromagnetic energy in at least three frequency bands.

17. A method of operating a user device, comprising:

inducing one or more currents at a single radio frequency (RF) input coupled to a antenna, wherein the antenna comprises a loop element coupled to the single RF input and ground, wherein the loop element comprises:

a first portion that perpendicularly extends along a back surface of an antenna carrier from a feeding point and away from a ground plane;

a second portion that extends along a top surface of the antenna carrier from a bend at a distal end of the first portion and towards a first side of the antenna carrier;

a third portion that wraps along an edge of the first side, wherein:

a first section of the third portion extends from the second portion and is disposed on the top surface of the antenna carrier, a second section of the third portion extends from the first section of the third portion to fold from the top surface of the antenna carrier to the first side of the antenna carrier, and a third section of the third portion extends from the second section of the third portion to fold from the first side of the antenna carrier to the top surface of the antenna carrier; and a fourth portion that wraps along an edge of the front surface, wherein:

a first section of the fourth portion extends from the third portion and is disposed on the top surface of the antenna carrier, a second section of the fourth portion extends from the first section of the fourth portion to fold from the top surface of the antenna carrier to the front surface of the antenna carrier, and a third section of the fourth portion extends from the second section of the fourth portion to fold from the front surface of the antenna carrier to the top surface of the antenna carrier; and radiating electromagnetic energy from the quad-mode antenna to communicate information to another device in response to the one or more currents.

18. The method of claim 17, wherein the radiating the electromagnetic energy comprises:

radiating the loop element as at 0.5 wavelength (λ) in a first mode of a four resonant modes;

radiating the loop element at 1λ in a second mode of the four resonant modes;

radiating the loop element at 1.5λ in a third mode of the four resonant modes; and radiating the loop element at 2λ in a fourth mode of the four resonant modes.

19. The method of claim 17, wherein the radiating the electromagnetic energy comprises:

radiating the loop element a first folded monopole antenna in an unbalanced two quarter-wavelength mode of a four resonant modes;

radiating the loop element a second folded monopole antenna in an unbalanced two three-quarter-wavelength mode of the four resonant modes;

radiating the loop element a third folded dipole antenna in a balanced two half-wavelength mode of the four resonant modes; and radiating the loop element a fourth folded dipole antenna in a balanced four half-wavelength mode of the four resonant modes.

20. The method of claim 17, wherein the radiating the electromagnetic energy comprises:

radiating the loop element to cover a low band frequency range of 698 MHz to 960 MHz; and radiating the loop element to cover a high band frequency range of 1710 MHz to 2350 MHz.

* * * * *